United States Patent [19]

Wells

[11] Patent Number: 4,930,650

[45] Date of Patent: Jun. 5, 1990

[54] SPENT NUCLEAR FUEL SHIPPING BASKET

[75] Inventor: Alan H. Wells, Duluth, Ga.

[73] Assignee: Nuclear Assurance Corporation, Norcross, Ga.

[21] Appl. No.: 338,861

[22] Filed: Apr. 17, 1989

[51] Int. Cl.[5] ..... G21F 5/00

[52] U.S. Cl. ..... 220/21; 206/443; 376/272

[58] Field of Search ..... 220/20, 21, 23.83, 3, 220/4 C; 206/443; 376/261, 272, 260, 239, 342

[56] References Cited

U.S. PATENT DOCUMENTS

| | | | |
|---|---|---|---|
| 3,600,792 | 8/1971 | Valluy et al. | 220/21 X |
| 4,446,098 | 5/1984 | Pomaibo et al. | 376/272 X |
| 4,666,659 | 5/1987 | Lusk et al. | 376/272 |
| 4,721,597 | 1/1988 | Wachter | 376/272 X |
| 4,760,637 | 8/1988 | Kerrey et al. | 376/261 X |
| 4,781,883 | 11/1988 | Daugherty et al. | 376/272 |
| 4,800,283 | 1/1989 | Efferding | 376/272 X |
| 4,803,042 | 2/1989 | Gilmore et al. | 376/272 |

*Primary Examiner*—Steven M. Pollard

[57] ABSTRACT

A spent nuclear fuel shipping basket and cask assembly has a basket made of a plurality of apertured metal disks maintained in spaced array and axial alignment. The basket has end caps which hold fuel assembly containing sleeves while permitting the fuel assembly to pass partially through the end caps and abut the end walls of the cask.

15 Claims, 3 Drawing Sheets

SPENT NUCLEAR FUEL SHIPPING BASKET

This invention relates to spent nuclear fuel shipping baskets for use in shipping casks.

BACKGROUND OF THE INVENTION

In a nuclear reactor, the fissionable material gradually becomes depleted to where it can no longer fuel a fission reaction, at which point the spent fuel must be removed and replaced. The spent fuel, which generally comprises a plurality of individual rods assembled in a bundle of substantially square cross-section, still may be highly radioactive, in which case it can be reprocessed to where it can again sustain or fuel a fission reaction.

It is generally necessary to ship the fuel over relatively long distances to the reprocessing plants, and thus it is essential that the spent fuel be packaged for shipping in such a manner that a high degree of safety, both to the outside world and to the rod assembly itself, is maintained. As a consequence, the rod assemblies are generally loaded into a basket which, in turn, is contained in a shipping cask. Such an assembly must be capable of preventing the escape of harmful radiation to the outside, but even more important, it must be capable of preventing neutron multiplication to a critical point through interaction among the several rod assemblies.

In addition to the neutron critically, the basket assembly must have sufficient structural strength to withstand sudden dynamic shocks such as occur in the fall of the cask onto an unyielding surface. Such a fall, for example, from a height of thirty feet, can create dynamic stresses that are catastrophic unless the basket has sufficient structural strength to withstand such impact loading.

Finally, the basket must be capable of transmitting fuel decay heat from the fuel assemblies to the cask walls with a degree of efficiency which will prevent heat buildup within the cask that exceeds safety limits. The Federal government, through the NRC, has specified a maximum interior heat of 380 degrees Celsius for storage purposes. For transport purposes, the allowable interior heat is approximately 535 degrees Celsius (1000 degrees Fahrenheit). Thus, any basket arrangement must be capable of conducting heat to the cask walls sufficient to maintain these or lower temperatures.

In U.S. Pat. No. 3,731,101 of Peterson et al, there is shown a shipping basket and cask arrangement that typifies prior art solutions to neutron criticality, strength and heat dissipation. Radiation shielding material completely fills the space surrounding the fuel assemblies, making a substantially solid assembly and heat radiating fins are mounted to the outer shell. Such an arrangement is both heavy and expensive to build, being prodigal in the use of radiation shielding material.

U.S. Pat. No. 4,177,938 of Heckman et al discloses a spent nuclear fuel cask arrangement which incorporates heat conducting fins into the structure thereof, and which does not require as much radiation shielding material as prior art devices typified by Peterson et al. However, the structure is not adapted to carry a plurality of fuel assemblies, and would require considerably more shielding if so adapted.

Some prior art devices utilize a grid lattice structure to carry the fuel elements, as shown in U.S. Pat. Nos. 4,066,500 of Woltron et al and 4,711,758 of Machado et al. Such grid structures tend to be lighter than other prior art arrangements, but their structural strength is not as great as the more massive prior art structures.

In U.S. Pat. No. Des 263,087 of Best et al, there is shown a basket arrangement in which the fuel assembly support means is also the heat radiating means, and the fuel containing members form a portion of the structure.

In all of the prior art arrangements, there is an interdependence among the three main desiderata of preventing neutron criticality in a structure capable of withstanding stresses and which has heat dissipation means. The more the accomplishment of these ends can be made independent of each other, the safer the overall structure becomes, since failure or inadequacy in accomplishing one end will not affect the accomplishment of the others.

SUMMARY OF THE INVENTION

The present invention achieves the desirable ends of radiation and interaction suppression and efficient heat dissipation in a structure that, while substantially lighter than most prior art structures, is capable of withstanding abnormal stresses during use.

In one preferred embodiment of the invention, a plurality of apertured disks are joined in a spaced array by means of a plurality of tie rods upon which are mounted spacer sleeves to maintain the disks in spaced relationship. The apertures in the disks are axially aligned and are each adapted to receive a fuel assembly containing sleeve preferably of the same material as the disks but which may be of a different material, such as, for example, borated aluminum. The apertures of the disks maintain the sleeves in spaced relationship to each other, an advantage most manifest in the loading of the fuel elements into the tubes, which will be discussed more fully hereinafter. Because of the disk and rod construction, the sleeves or tubes do not function as structure, thereby relieving them of structural stresses.

An apertured end cap is provided for each end of the basket structure, the apertures in each cap being oriented to align with the apertures in the disks. The apertures in each end cap are stepped, thereby forming shoulders against which the fuel containing sleeves rest and are restrained from movement after the end caps are bolted in place. On the other hand, the fuel rod assemblies can move into or through the apertures in the end caps. With this configuration, the end cap which functions as the bottom cap when the basket is inserted into the cask, permits the fuel rod assembly to rest against the interior bottom of the cask and thus the cask itself functions to conduct heat away from the interior. A spacer member, insertable into the individual sleeves, is provided for filling the sleeve in those instances where the fuel rod assembly does not completely fill the sleeve.

In a second illustrative embodiment of the invention, alternate disks are fabricated from a high heat conductive material, such as copper. The copper disks may be attached to one of the adjacent disks, which is, for example, made of steel, or they may be spaced therefrom. With such high conductive material heat transfer to the side walls of the cask is materially enhanced, hence the assembly temperature is greatly reduced.

In a third embodiment of the invention, four of the sleeves, located at the corners of the pattern of apertures, are of the same material as the disks, and are welded thereto, while the remaining sleeves may be of a different material.

In all of the embodiments of the invention, the disk and unique end cap construction result in a light weight, highly stress resistant basket, in which the fuel element containing sleeves do not perform any structural function, thereby allowing them to be made of efficient neutron poisoning material, and in which heat is efficiently conducted to the cask walls.

These and other features of the present invention will be more readily apparent from the following detailed description and the accompanying drawings.

DETAILED DESCRIPTION

Figure 1:
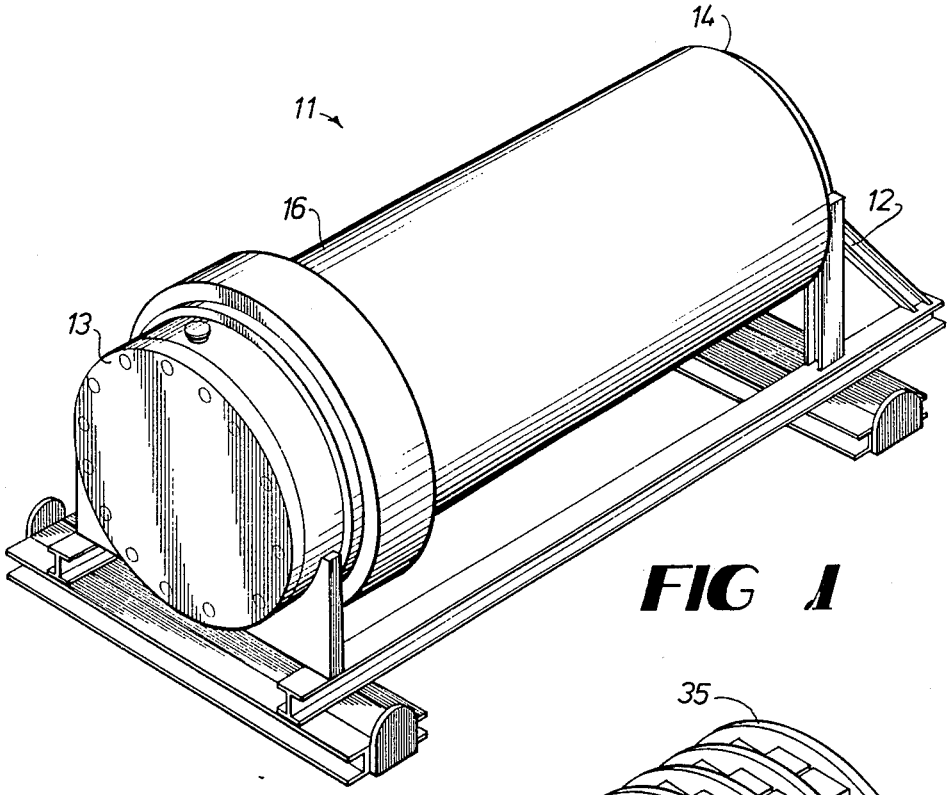
FIG. 1 is a perspective view of a shipping cask in which the present invention is used.
Figure 2:
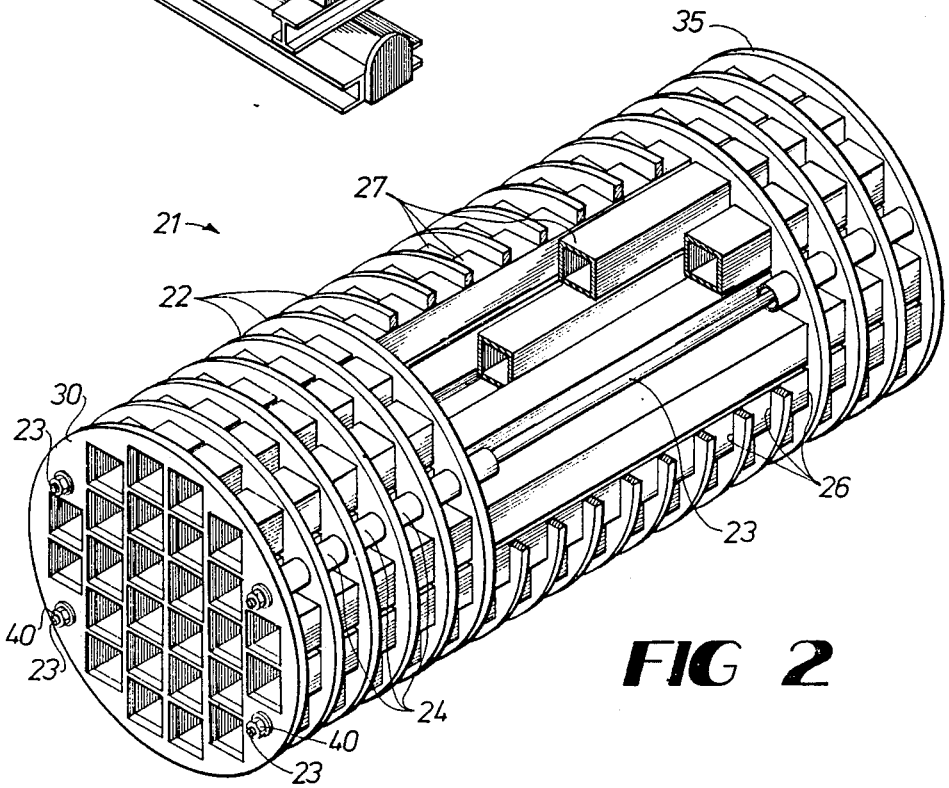
FIG. 2 is a perspective partially sectional view of the basket of the present invention.

In FIG. 1 there is shown a typical spent nuclear fuel shipping cask 11, mounted in a shipping cradle 12. Cask 11 is adapted to carry a shipping basket, as shown in FIG. 2, and is sealed with end plates 13 and 14 which function to hold the shipping basket in place longitudinally. The cask may include an outer jacket 16 for containing water which helps contain any neutrons that may penetrate the walls of the cask. The basket is sized to be a sliding fit in the interior of the cask 11, so that, with end plates 13 and 14 in place, the basket is held firmly in place within the cask 11. End plate 14 may be an integral part of the cask and forms the cask "bottom".

FIG. 2 depicts a fuel basket 21 for use in a cask such as that depicted in FIG. 1. Basket 21 comprises a plurality of apertured disks 22, 22, best seen in FIG. 4, which are mounted on tie rods 23, 23 and maintained in spaced relationship by means of spacers 24, 24 which may be slip-fitted on tie rods 23, 23. The tie rods hold the disks and orient them so that their apertures are aligned throughout the length of the basket. The apertures 26, 26 of the disks 22, 22 are adapted to receive and support fuel assembly containing sleeves 27, 27 since the apertures 26, 26 in all of the disks 22, 22 are aligned when the disks are mounted on the tie rods 23, 23. Disks 22, 22 are made of either steel or aluminum, and rods 23, 23 and spacers 24, 24 are preferably made of the same material as the disks. Aluminum disks, rods and spacers have the advantage over steel of light weight, and, for the disks, high heat conductivity as compared to steel. Steel, on the other hand, offers greater mechanical strength and load bearing capacity. With such a construction as depicted in FIG. 2, the sleeves 27, 27 are not required to function as structure and therefore may be made of a neutron poisoning material such as Boral, borated aluminum or steel or cadmium. Thus, the tubes themselves function to prevent neutron criticality, while the basket structure is sufficiently strong to withstand severe stresses and the disks function to conduct decay heat to the cask walls.

Basket 21 has first and second apertured end plates 30 and 35, which will be discussed in more detail with regard to FIGS. 6, 7, 8 and 9. For identification purposes, plate 30 will hereinafter be referred to as the top plate and plate 35 as the bottom plate. The entire assembly of disks, rods and spacers, with sleeves 27, 27 in place, is bolted together by nuts 40, 40 mounted on threaded extended ends of the rods 23, 23.

Figure 3:
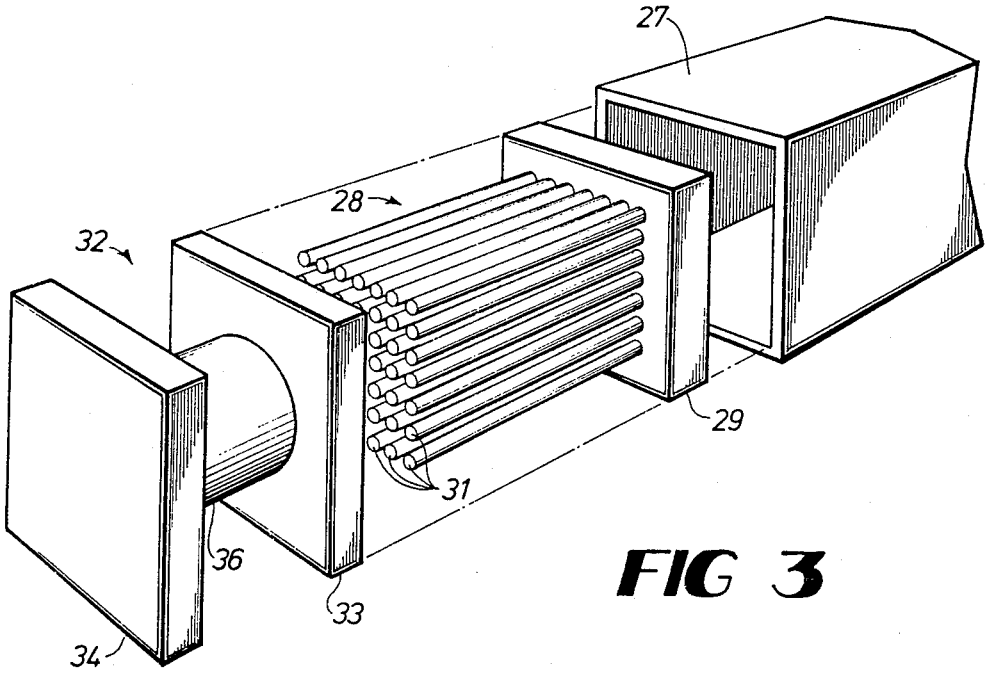
FIG. 3 is a perspective partial view of the relationship of various elements of the present invention.

In FIG. 3 there is shown a portion of a tubular sleeve member 27 and a portion of the fuel rod assembly 28 which comprises a square base member 29 having fuel rods 31, 31 mounted thereon. The other end of assembly 28 (not shown) likewise has a square base member. Rod assembly 28 is a virtual slip fit in sleeve member 27 so that when it is fully inserted into member 27, it is held snugly with respect to lateral movement, but is free to move longitudinally. A spacer member 32 comprising square end members 33 and 34 joined by a shaft 36 functions to fill the sleeve 27 in those cases where the fuel rod assembly 28 is shorter than sleeve 27. End members 33 and 34 are preferably of the same dimensions as base member 29 so as to be slip fit within sleeve 27. Spacer 32 is preferably made of a heat conducting material, such as aluminum or copper, to conduct heat away from the fuel rod assembly.

In practice, basket 21 is assembled with plates 30 and 35 bolted in place and the fuel rod assemblies 28 are then loaded in the sleeves 27. Loading generally takes place under water, which is a neutron inhibitor, and the structure of the basket allows the water to surround each sleeve, thereby preventing neutron interaction between sleeves.

Figure 4:
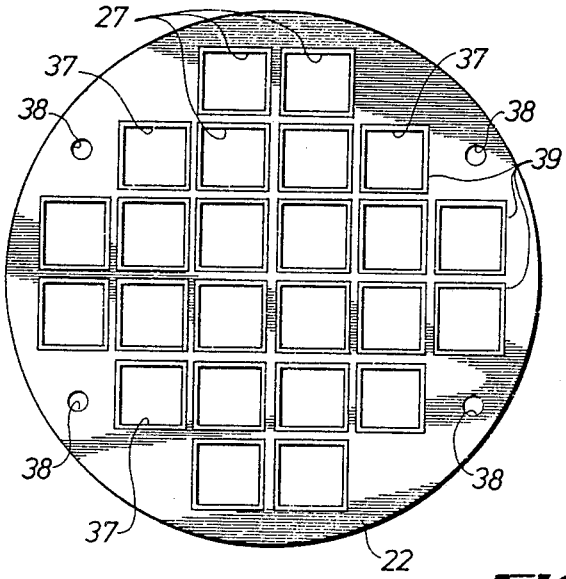
FIG. 4 is a front elevation view of a component of the invention.
Figure 5:
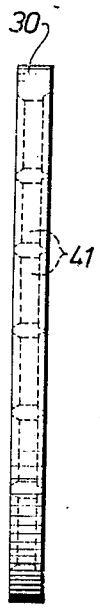
FIG. 5 is a side elevation view of the component of FIG. 4.

In FIG. 4 there is shown a front elevation view of a typical disk 22 of the invention, and FIG. 5 depicts a side elevation view of the disk of FIG. 4. As can be seen, disk 22 has a plurality of geometrically arranged square apertures 39, 39 through which pass and are supported thereby sleeves 27, 27. Disk 22 is provided with four holes 38, 38 through which pass tie rods 23, 23. In some applications, where additional structural strength is desired or required, the sleeves designated 37, 37 in FIG. 4 may be welded to the disks. This is preferably done only where the disk and the sleeve are made of steel, inasmuch as welding aluminum actually tends to weaken it. In FIG. 5 it can be seen that the apertures 39, 39 are chamfered slightly to facilitate insertion of sleeves 27, 27 in and through the apertures.

Figure 6:
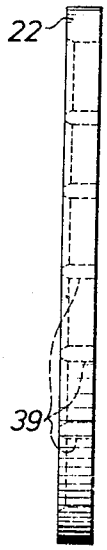
FIG. 6 is a side elevation view of one end cap of the basket of the invention.
Figure 8:
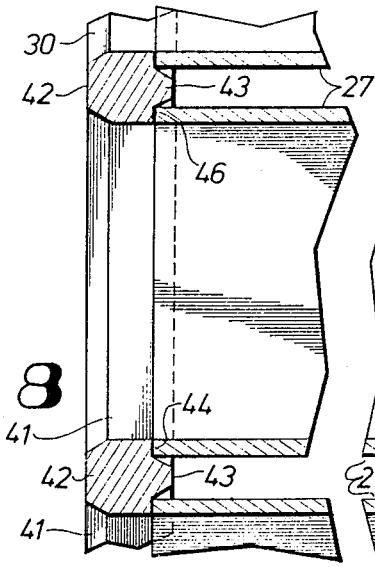
FIG. 8 is an enlarged detail view of a portion of the cap of FIG. 6.

FIG. 6 is a side elevation view of top plate 30 and FIG. 8 is an enlarged sectional view of plate 30, illustrating a detail of the configuration of plate 30. In FIGS. 6 and 8, it can be seen that the apertures 41, 41 of plate 30 are separated from each other by intermediate portions 42 of cap 30, the portions 42 having a first tapered portion 43 ending in pairs of shoulders 44, 46, against which the ends of sleeves 27 bear, as best seen in FIG. 8. It can be seen from FIGS. 6 and 8 that the interior dimensions of apertures 41 match the interior dimensions of sleeves 27, thus permitting loading of the sleeves with fuel elements 28 after top plate 30 is in place.

Figure 7:
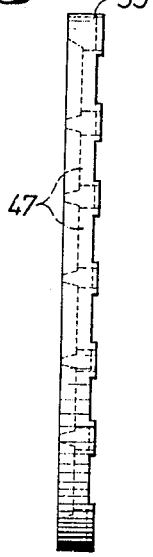
FIG. 7 is a side elevation view of the other end cap of the basket of the invention.
Figure 9:
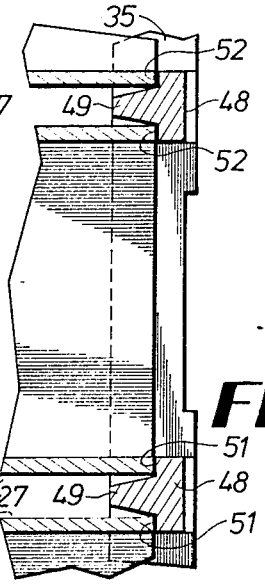
FIG. 9 is an enlarged detail view of a portion of the cap of FIG. 7.

FIGS. 7 and 9 are a side elevation view and an enlarged detail, respectively, of bottom plate 35. The apertures 47, 47 of plate 35 are separated from each other by intermediate portions 48, each of which has a first tapered portion 49 at the bottom of which are formed pairs of shoulders 51, 52, against which the ends of sleeves 27 bear. As is the case with top plate 30, the apertures 47, 47 match the interior dimensions of sleeves 27, so that fuel elements 28 may pass through bottom plate 35.

Figure 11:
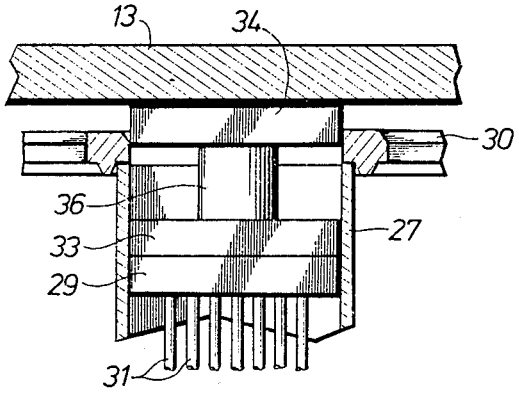
FIG. 11 is a cross-sectional view of the relationship of the fuel rod assembly, basket and cask of the other end from the end depicted in FIG. 10.
Figure 10:
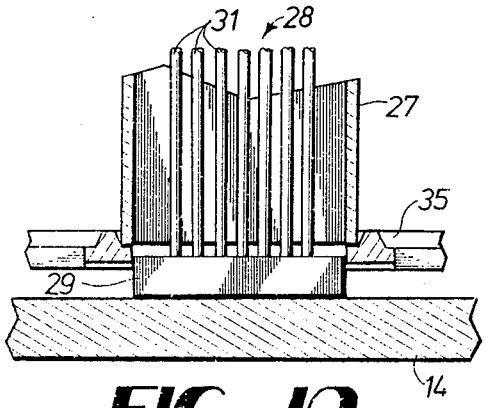
FIG. 10 is a cross-sectional view of the relationship of the fuel rod assembly basket, and cask after assembly.

FIG. 10 is a sectional view of the relationship of the basket, the fuel elements and the cask bottom after the basket has been loaded and inserted in the cask. It can be seen that bottom plate 35 is spaced from the cask bottom 14 because of the threaded extensions of tie rods 23, to which nuts 40 are attached. However, fuel rod assembly 28 passes through apertures 47 in bottom plate 35 so that base members 29 rest against the bottom 14 of the cask, thus assuring good heat transfer to the cask walls. FIG. 11 is a sectional view of the top portion of the cask and basket. As can be seen, top plate 30 is, like bottom plate 35, separated from end plate 13 of the cask, and in the case illustrated, the fuel rod assembly 28 is considerably shorter than the basket and sleeve dimensions, thus necessitating the insertion of spacer members 32 which bear against base members 29 at one end 33, and against end plate 13 at the other end 34. Spacer 32 can be made adjustable in length, or various lengths of spacers may be available. The function of spacer 32 is to ensure that the fuel rod assembly 28 is firmly held so that its bottom end base member 29 bears against the bottom 14 of the cask, and longitudinal movement of assembly 28 within the sleeve 27 is prevented. At the same time, spacer 32 which is of suitable heat conducting metal conducts heat from the fuel rod assembly 28 to the interior surface of the cask.

Figure 12:
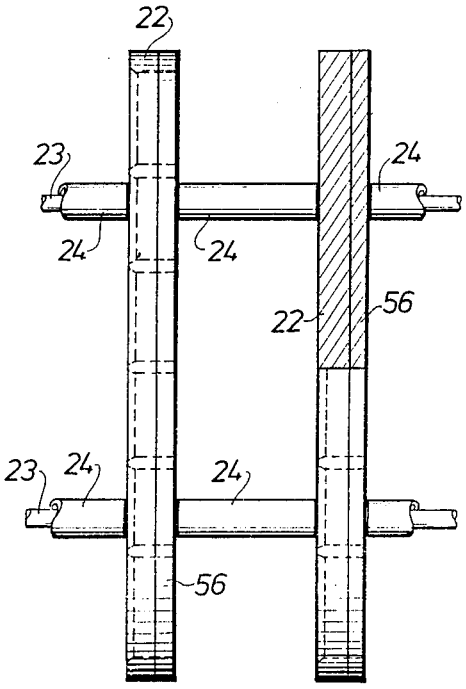
FIG. 12 is a side elevational view of a portion of a modified basket of the present invention.

In those situations where it is desirable or necessary to fabricate the disks 22, tie rods 23 and spacers 24 from steel, the steel disks 22, cannot always be relied upon to conduct sufficient heat away from the fuel assemblies. In FIG. 12 there is shown an arrangement for ensuring that heat conductivity is sufficient to prevent damage. Adjacent each steel disk 22 is a relatively thin, apertured disk 56 of a material having a high heat conductivity such as, for example, copper. Disk 56 may be attached to disk 22 as by brazing or it may be bolted thereto, or merely held in abutting relationship with disk 22 by means of spacers 24. On the other hand, the structure may be as shown in FIG. 2, with every other disk being of high heat conductivity material. As used herein, "high heat conductivity" denotes such a conductivity greater than that of steel, and which ensures transfer of heat away from the fuel elements sufficient to maintain the assembly at safe temperature levels.

It is readily apparent from the foregoing that the invention comprises a new spent nuclear fuel basket assembly that is sufficiently strong to withstand the application of severe dynamic stresses thereto, that ensures sufficient heat transfer to maintain the fuel basket and cask assembly at safe temperature levels, and that suppresses neutron action to prevent neutron multiplication from reaching a critical point. In all of the foregoing, the fuel rod assemblies, the sleeves and the apertures in the disks are of square configuration. If the fuel assemblies are other than square configuration, the sleeves and apertures obviously may be configured to accommodate the assemblies.

While the foregoing illustrative embodiments of the invention represent preferred forms thereof, various modifications and changes may occur to persons skilled in the art without departure from the spirit and scope of the invention.

What is claimed is:

1. A basket for a cask for transporting nuclear fuel elements, said basket comprising a plurality of sleeve members, each of said sleeve members having interior cross-section dimensions for receiving a nuclear fuel assembly such that the assembly is restrained from lateral movement within said sleeve member, a plurality of apertured disk members, means for axially aligning the apertures in said disk members, means for maintaining said disk members in fixed spaced relationship to form a disk assembly, comprising an array of disks, the aligned apertures of said disks being adapted to receive said sleeve members and maintain them in fixed spaced relationship, first and second apertured end caps, the apertures of which are stepped to form first and second different cross-sectional aperture dimensions and forming a shoulder therebetween, the first cross-sectional dimensions of each aperture being adapted to receive the end of a sleeve, so that said end bears against said shoulder and the second cross-sectional dimension of each aperture being substantially the same as the internal cross-section of said sleeve, and means for maintaining said first end cap to one end of the disk assemblies and said second end cap to the other end of said disk assembly with the apertures in said end caps axially aligned with the apertures in said disks.

2. A basket as claimed in claim 1 wherein said apertured disks are aluminum.

3. A basket as claimed in claim 1 wherein said apertured disks are steel.

4. A basket as claimed in claim 1 wherein said sleeves are of the same material as said disks.

5. A basket as claimed in claim 1 wherein said sleeves are of borated aluminum.

6. A basket as claimed in claim 1 wherein the means for axially aligning the apertures in said disks comprises a plurality of tie rods extending the length of the disk assembly.

7. A basket as claimed in claim 6 wherein said means for maintaining said disks in fixed relationship comprises a plurality of spacers mounted on said tie rods between successive disks.

8. A basket as claimed in claim 1 wherein a first plurality of disks in the array of disks are of a material having a first heat conductivity characteristic and a second plurality of disks in the array of disks are of a material having a second heat conductivity characteristic greater than that of the first plurality of disks.

9. A basket as claimed in claim 8 wherein each of the second plurality of disks is located between two disks of the first plurality of disks in the array of disks.

10. A basket as claimed in claim 9 wherein each disk of the second plurality of disks abuts a disk of the first plurality of disks.

11. A basket as claimed in claim 8 wherein the material of the disks in the second plurality of disks is copper.

12. A basket as claimed in claim 1 wherein at least one of said sleeves is attached to the disks through which it passes.

13. A basket and cask assembly for transporting nuclear fuel assemblies comprising:

a substantially hollow cylindrical cask having first and second end plates and containing a basket, said basket comprising an array of spaced apart apertured disk members, means for maintaining said disks in spaced relationship with the apertures thereof axially aligned, a plurality of sleeve members adapted to receive and support nuclear fuel assemblies, said sleeve members being supported in the apertures of said disks, said basket having first and second apertured end caps, each of the apertures in said end caps having a first cross-sectional dimension of sufficient size to receive the end of said sleeve and a second cross-sectional dimension smaller than said first cross-sectional dimension to prevent the sleeve from passing through the said end cap, said second cross-sectional dimension being of sufficient size to permit passage of a nuclear fuel assembly therethrough, whereby a nuclear fuel assembly carried by said sleeve passes through said end cap and abuts an end plate of said cask.

14. A basket and cask assembly as claimed in claim 13 and further including means for filling each of said sleeves when the nuclear fuel assembly is shorter than said sleeve containing it.

15. A basket and cask assembly as claimed in claim 14 wherein said means for filling comprises a spacer member of heat conducting material.

* * * * *